United States Patent [19]

Mitchell

[11] 4,309,009

[45] Jan. 5, 1982

[54] TOOL TRAY AND SUPPORT THEREFOR

[76] Inventor: Richard H. Mitchell, 269 Dedham St., Rte. 1A, Norfolk, Mass. 02056

[21] Appl. No.: 117,307

[22] Filed: Jan. 31, 1980

[51] Int. Cl.[3] ..... A47G 23/02

[52] U.S. Cl. ..... 248/149; 211/72

[58] Field of Search ..... 248/146, 149, 154, 150, 248/151, 152, 148, 172, 310, 311.2, 313; 211/72

[56] References Cited

U.S. PATENT DOCUMENTS

| | | | |
|---|---|---|---|
| 689,446 | 12/1901 | Wolfskill | 248/148 X |
| 1,471,931 | 10/1923 | Trout | 248/172 |
| 2,223,075 | 11/1940 | McClaskey | 248/151 |
| 2,534,114 | 12/1950 | Faris | 248/151 X |
| 2,671,628 | 3/1954 | Everhard | 248/151 |

FOREIGN PATENT DOCUMENTS

| | | | |
|---|---|---|---|
| 787413 | 12/1957 | United Kingdom | 248/151 |

*Primary Examiner*—J. Franklin Foss

*Attorney, Agent, or Firm*—James H. Grover

[57] ABSTRACT

A pair of supporting attachments are adapted to engage automotive mechanic's tool trays of various sizes so as to stably position the tray on a tire. Each support comprises two legs of sheet material overlapping under the tray with their upper edges engaging and supporting the bottom of the tray. Hooked extensions from the sheet legs engage the sidewalls of the tray slidingly lengthwise to allow for adjustment to tires of various diameters. The overlapping leg sheets are adjustably fastened together, as by a wing nut, to accommodate trays of different widths.

9 Claims, 2 Drawing Figures

TOOL TRAY AND SUPPORT THEREFOR

BACKGROUND OF THE INVENTION

At one time a mechanic working on a truck could place his tool tray on the fender or running board to service the engine, but now the running board and fender are part of a cab which is lifted off the engine leaving the mechanic no level place to set his tool tray.

It is the object of this invention to provide a device for supporting a tool tray on a curved support such as the truck tire which is exposed when the truck cab is lifted for servicing.

STATEMENT OF THE INVENTION

According to the invention a device for attachment to a tray with a bottom and sidewalls comprises a leg having two overlapping leg sheets, the upper end of each sheet having an edge for engaging and supporting the bottom of the tray; extensions from each leg sheet including means engaging the tray sidewalls; and means for laterally adjustably fastening the sheets together so as to clamp the leg pieces to the bottom and sides of the tray, whereby flat trays of varying sizes may be stably supported on a curved surface.

DRAWING

DESCRIPTION

Figure 1:
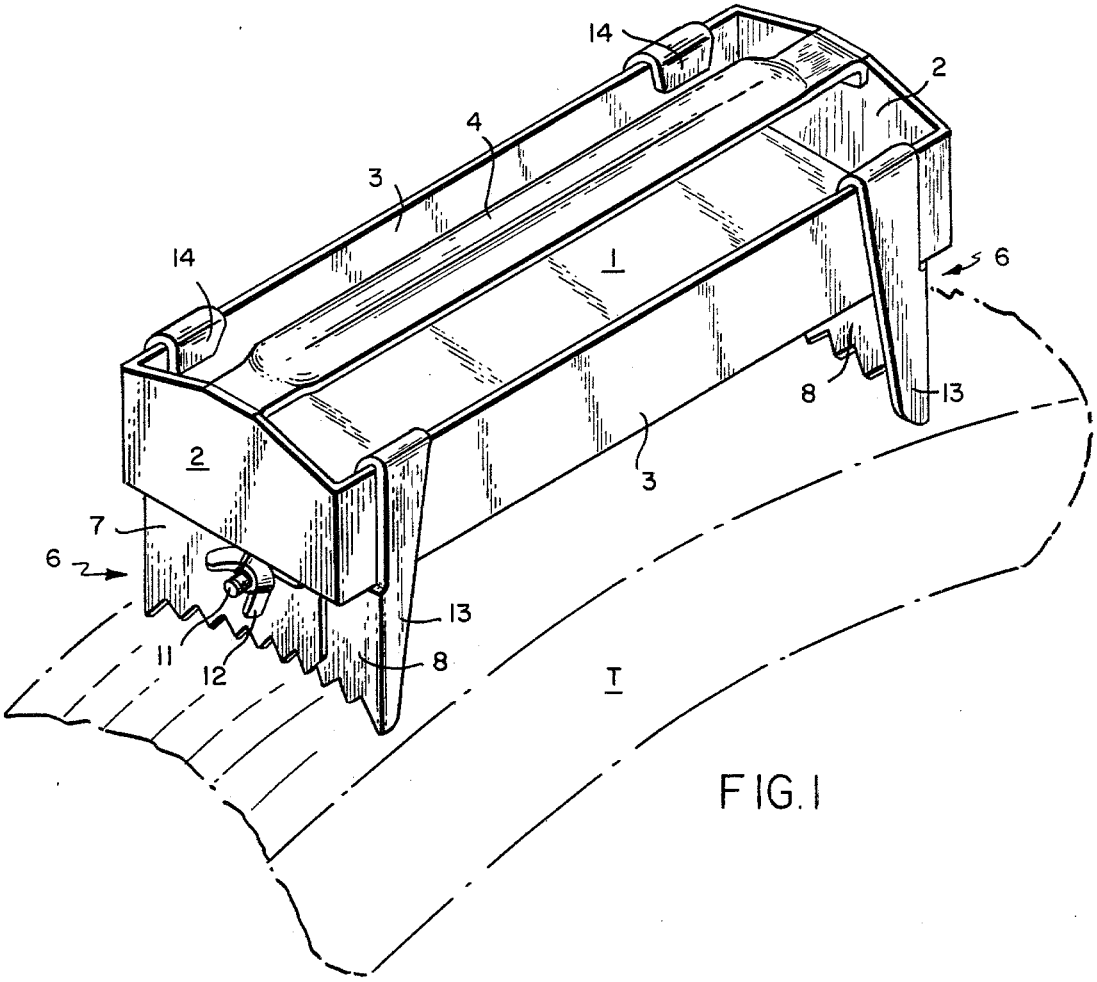
FIG. 1 is an isometric view of a tool tray and its supporting attachments.
Figure 2:
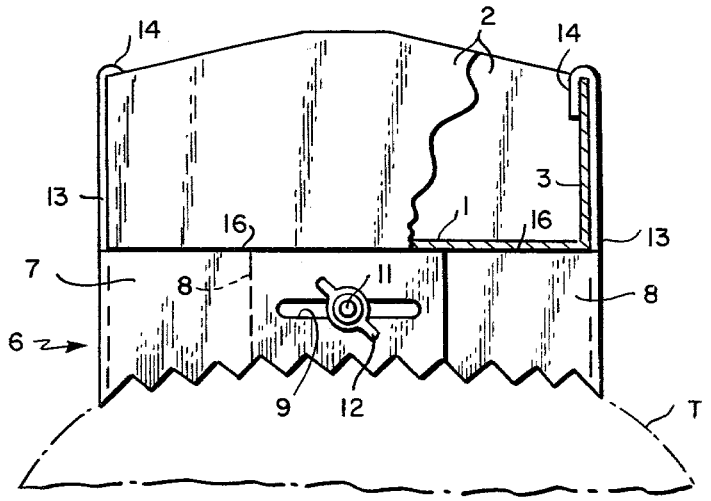
FIG. 2 is an end view of the support and tray partly broken away.

As shown in FIGS. 1 and 2 a typical automotive mechanic's tray comprises a bottom 1, end walls 2, sidwalls 3 and a handle 4. Such a flat bottomed tray cannot be safely balanced on a curved surface such as a tire.

The attachment device of the present invention which makes it possible to rest the tool tray stably on an automotive tire comprises a pair of legs 6, each including two metal sheets 7 and 8 which overlap. At least one leg sheet 7 has a slot 9 through which a bolt 11 passes and secures the two sheets together with a wing nut 12. Extending upward from each leg sheet is a flange 13 folded at right angles to the leg sheets and also folded at its upper end to form a hook 14 which engages over the tray sidewall 3.

The adjustable fastening nut 12 and bolt 11 allow the legs to accommodate trays of different widths. Also the legs 6 can accommodate trays of different lengths by sliding lengthwise of the tray.

When the wing nut is tightened the upper edges 16 (FIG. 2) of the leg sheets 7 and 8 and the opposed extension hooks 14 clamp the legs 6 on the tray.

Preferably the lower edges of the leg sheets are curved to conform to the curve of a tire T on which they rest. They are also preferably toothed to bite into the tire.

With one or preferably two such supporting attachment devices 6 mechanics' trays of different widths and lengths may be stably supported on a truck tire for instance, within convenient reaching distance of the mechanic working on the truck engine.

It should be understood that the present disclosure is for the purpose of illustration only and that this invention includes all modifications and equivalents which fall within the scope of the appended claims.

What is claimed is:

1. A device for attachment to a tray with a bottom and side walls comprising:

a leg having two laterally adjustable overlapping leg sheets, the upper end of each sheet having an edge for engaging and supporting the bottom of the tray, and the lower edges of the leg sheets extending substantially transversely of the tray;

extensions from each leg sheet including means engaging the tray side walls; and means for laterally adjustably fastening the sheets together so that the sheets are mutually supporting and so as to clamp the leg pieces to the bottom and sides of the tray, the two leg sheets cooperating with each other and the tray to form a rigid assembly presenting a footing at the lower edges of the leg sheets whereby flat trays of varying sizes may be stably supported on curved surfaces of different widths and curvatures.

2. A device according to claim 1 wherein the extensions are folded flanges adapted to hook over each tray sidewall.

3. A device according to claim 2 wherein the flange folds are slideable lengthwise of the tray sidewalls.

4. A device according to claim 2 wherein the flanges are opposed to the sheet edges, thereby to clamp the legs on the tray.

5. A device according to claim 1 wherein the lower edge of the leg sheets is curved to seat on an automotive tire.

6. A device according to claim 5 wherein the lower edge is toothed.

7. A tool holder comprising a tray having a bottom and sidewalls in combination with an attachment device according to claim 1.

8. A tool holder comprising a tray in combination with attachment devices according to claim 1 at each end of the tray.

9. A device according to claim 1 or claim 5 wherein a continuous footing is formed by the lower edges of the overlapping sheets.

* * * * *